United States Patent [19]

Cage et al.

[11] Patent Number: 4,571,337

[45] Date of Patent: Feb. 18, 1986

[54] CONTAINER AND POPCORN INGREDIENT FOR MICROWAVE USE

[75] Inventors: James K. Cage, Santa Ana; Shanti Kolla, Ontario; Jan E. Gates, Anaheim, all of Calif.

[73] Assignee: Hunt-Wesson Foods, Inc., Fullerton, Calif.

[21] Appl. No.: 750,982

[22] Filed: Jul. 1, 1985

Related U.S. Application Data

[63] Continuation of Ser. No. 609,279, May 10, 1984, abandoned.

[51] Int. Cl.[4] ..... B65D 81/34

[52] U.S. Cl. ..... 426/107; 426/113; 426/118; 206/632; 229/DIG. 14; 383/35; 383/100

[58] Field of Search ..... 426/107, 111, 113, 118, 426/395, 412, 234; 206/632, 633; 229/DIG. 14; 383/35, 100, 120

[56] References Cited

U.S. PATENT DOCUMENTS

| | | | |
|---|---|---|---|
| 2,189,174 | 2/1940 | Hohl | 206/632 |
| 2.633,284 | 3/1953 | Moffett et al. | 426/118 |
| 2,865,768 | 12/1958 | Barnes et al. | 426/111 |
| 3,023,947 | 3/1962 | McDuffie | 383/120 |
| 3,052,554 | 9/1962 | Colman | 426/111 |
| 3,188,215 | 6/1965 | Snow | 426/114 |
| 3,204,760 | 9/1965 | Whiteford | 426/113 |
| 3,293,048 | 12/1966 | Kitterman | 426/113 |
| 3,478,952 | 11/1969 | Perlman | 426/113 |
| 3,511,746 | 5/1970 | Davies | 426/113 |
| 3,851,574 | 12/1974 | Katz et al. | 426/111 |
| 3,865,302 | 2/1975 | Kane | 426/113 |
| 3,973,045 | 8/1976 | Brandberg et al. | 426/111 |
| 3,997,677 | 12/1976 | Hirsch et al. | 426/118 |
| 4,013,798 | 3/1977 | Goltsos | 426/118 |
| 4,141,487 | 2/1979 | Faust | 426/111 |
| 4,145,449 | 3/1979 | Nelham | 206/632 |
| 4,210,674 | 7/1980 | Mitchell | 426/107 |
| 4,261,504 | 4/1981 | Cowan | 426/118 |
| 4,292,332 | 9/1981 | McHam | 426/111 |
| 4,358,446 | 11/1982 | Stevenson | 426/118 |
| 4,390,554 | 6/1983 | Levinson | 426/107 |
| 4,456,164 | 6/1984 | Foster et al. | 426/113 |

*Primary Examiner*—Steven Weinstein
*Attorney, Agent, or Firm*—Pretty Schroeder Brueggemann & Clark

[57] ABSTRACT

A shelf-stable combination of an easily openable bag and a mixture of edible popcorn ingredients is suitable for use in microwave ovens. The bag includes a bottom panel, a top panel, a back panel, and inwardly folded gusseted side panels such that the bag can be flattened along the top edge opposite the bottom panel. The bag is formed by an outer layer of paper and an inner layer of non-wicking material with a coating that is sensitive to a combination of heat and pressure. A peelable seal is formed by the coating along the top edge such that the bag can be opened along that edge by pulling on diagonally opposite corners. The ingredients include corn kernels having a moisture content of about 11.5 percent or more and the peelable seal has sufficent strength to remain closed for at least one-half of the time required to pop substantially all of these kernels. The top edge seal opens before popping is completed to release steam and prevent the popped corn from becoming too chewy.

13 Claims, 8 Drawing Figures

CONTAINER AND POPCORN INGREDIENT FOR MICROWAVE USE

This application is a continuation of application Ser. No. 609,279, filed May 10, 1984, now abandoned.

FIELD OF THE INVENTION

The present invention relates to popcorn and easily opened containers therefor and more particularly to such a combination that is suitable for use in a microwave oven.

BACKGROUND OF THE INVENTION

A variety of popcorn containers are known in which corn kernels can be popped on or in a conventional stove. One such container is described in U.S. Pat, No. 3,110,233 to Mennen entitled "Apparatus for Shaping Metal Foil." Containers of this general type are, however, not suitable for use in microwave ovens where foil is prohibited. Accordingly, paper containers have been devised for popping corn in microwave ovens, an example being U.S. Pat. No. 3,973,045 to Brandburg et al entitled "Popcorn Package for Microwave Popcorn." It should be noted that these containers are specially constructed for microwave use and generally are not usable in other types of ovens because the paper will burn.

Presently known paper containers for popcorn ingredients do, however, have significant drawbacks. They are permeable by the included shortening or oil and are thus subject to staining and require refrigeration to prevent the migration of the shortening to the outside of the paper. If refrigerated prior to use, they tend to conduct heat through the oven floor, thus creating a cold spot and reducing the effectiveness of the popping action. Moreover, known paper containers tend to be permeable by steam, thus allowing steam to escape with the result that the temperature within the container is lowered and the popping action is less effective, leaving a higher proportion of unpopped kernels. If the container is not permeable by steam it suffers from the disadvantage that the steam, if allowed to remain in the container, may result in the popped kernels becoming too chewy within a very short time. Paper is also less easily torn when compared to metal foil and is therefore difficult to open, especially when hot. Relatively complex and costly to manufacture closure arrangements are therefore required to overcome this problem.

SUMMARY OF THE INVENTION

The present invention provides a combination of popcorn ingredients and a container therefor suitable for microwave use that overcomes many of the problems referred to above. In general, the bag is of a conventional standup configuration, having a bottom panel, front and back panels, and inwardly folded gusseted side panels. An edge of the bag opposite the bottom panel can be folded flat. The bag is made of paper with an inner layer of non-wicking material, preferably a polyester, such as polyethylene terephthalate (PET). An adhesive coating, preferably also polyester, is applied to the inner layer forming a peelable seal along the top edge.

The popcorn ingredients within the bag include corn kernels and a shortening, the shortening preferably being a solid at room temperature. The moisture content of the kernels is at least about 11.5 percent and preferably between 13 and 14 percent. The peelable seal has sufficient strength to withstand the internal steam pressure generated by this moisture content for at least one-half of the popping process. Preferably, the bag will vent at the top seam before the process is completed to allow steam to escape. Venting of steam for at least the last 30 seconds of the process is preferred.

In one preferred form of the invention there is a center strip extending vertically along the bag between the gussets where the front and back panels contact each other when the bag is folded flat. The seal formed by heat and pressure at the top edge has the least strength along the center strip where there are few layers of material. The portion of the seal corresponding to the center strip is therefore the portion where venting usually occurs. This venting action allows steam to escape so that the popped corn kernels will not become too chewy.

Other features and advantages of the present invention will become apparent from the following detailed description which, taken in conjunction with the accompanying drawings, illustrates, by way of example, the principles of the invention.

DESCRIPTION OF THE PREFERRED EMBODIMENT

Figure 1:
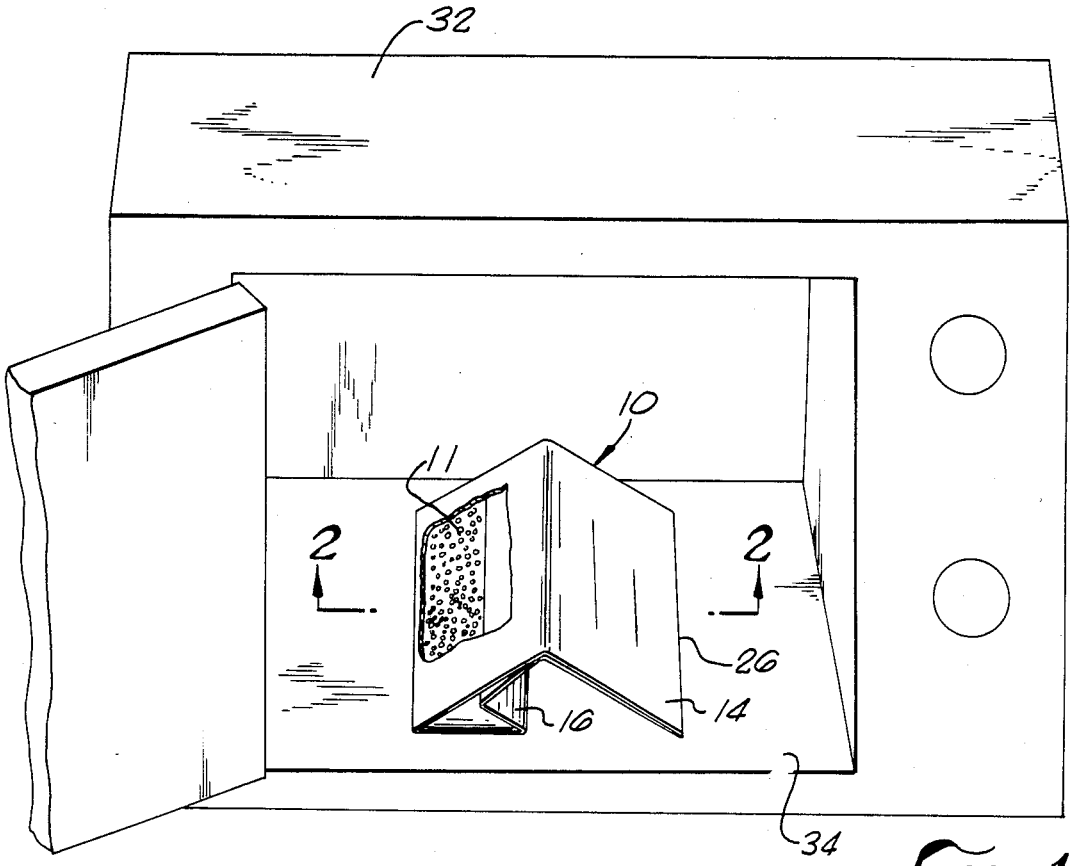
FIG. 1 is a view of the front and top (partially broken away) of a bag and contents, in accordance with the invention, positioned within a microwave oven.

A popcorn bag 10 and its contents 11, suitable for microwave use and constructed in accordance with the present invention, is shown in FIGS. 1–8 of the accompanying drawings. The general configuration of the bag 10 is of the conventional standup type, having a flat rectangular bottom panel 12, rectangular front and back panels 14 and 16, and inwardly folded gusseted side panels 18.

The ingredients 11 are placed inside the bag adjacent to the bottom panel 12. These ingredients 11 consist principally of corn kernels, shortening and salt. Preferably, the kernels are all of approximately equal size so that substantially all kernels will pop uniformly and within a narrow time frame, the popping time in a microwave oven being dependent upon kernel size. Since popping is attributable to the moisture content, it is important that there be sufficient moisture. There should be at least 11.5 percent moisture content by weight in the kernels and a content of 13 to 14 percent is better, 13.5 being optimum. Too little moisture results in small popped kernels the density of which is too high to produce the fluffy texture desired.

The ingredients 11 also include a shortening that is a solid at room temperature. No refrigeration is required and the product is thus shelf-stable. Animal fats may be desirable because they tend to generate higher temperatures for better popping action.

The bag 10 is formed of an outer layer of a single sheet of kraft paper 20 (see FIG. 5) treated with a commercially available stain inhibitor. An inner layer 22 is a polyester film such as polyethylene terephthalate, an example being O-L Mylar film available from DuPont. Alternative inner layer materials would be coextruded and possibly other multi-ply films of polyethylene terephthalate, as outer plies, with polycarbonate (such as Lexan made by General Electric) and ethylene vinyl alcohol as middle plies. The preferred thickness of this film 22 is about 0.5 to 1.0 mils and it should be capable of withstanding temperatures of 350° to 450° F., as will be encountered in a microwave oven, without melting or otherwise contaminating or imparting flavor to the ingredients 11. A coating sensitive to a combination of heat and pressure, commonly referred to as a heat seal coating, (not identified separately in the drawings) is applied to the exposed interior surface of the film 22. The coating is also polyethylene terephthalate, being chemically similar to the underlying film 22, but the coating is amorphous and therefore sealable whereas the inner layer is crystalline.

Figure 6:
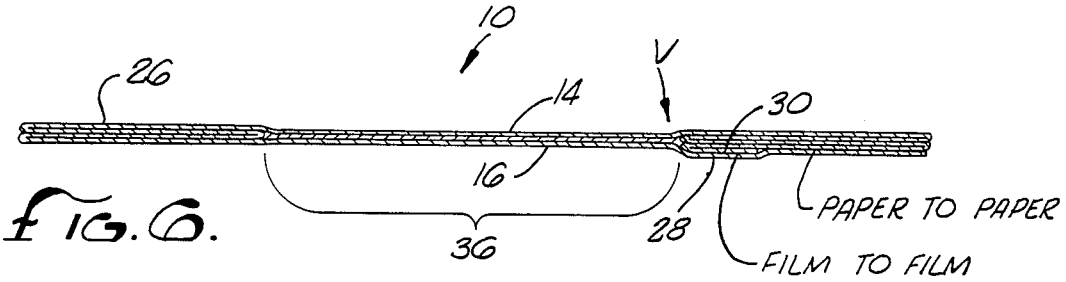
FIG. 6 is a top view showing the top edge of the bag, the thickness of the layers being exagerated for clarity.

All of the seams of the bag 10 are sealed by the coating, and all seams except that extending along a top edge 26 opposite the bottom panel 12 have an additional backup seal (not shown in the drawings) where the paper 20 is not covered by the film 22 and the paper surfaces are glued together. This is accomplished along a vertical seam 28 extending up the back panel 16, as shown in FIG. 6, by where two adjoining ends of the paper 20 meet. One edge 30 is folded over at the point of overlap to form a film-to-film seal on the part of the overlap closest to the interior of the bag 10. The remainder of the overlap portion forms a paper-to-paper seal. Since the paper-to-paper seal is the outer seal and the film-to-film seal is an inner seal, the entire interior surface of the bag 10 that is exposed to the ingredients 11 is covered by the film 22 and the ingredients 11 cannot come into direct contact with the paper 20. The film 22 is impermeable to the shortening which would otherwise tend to seep through the paper 20 at room temperature causing discoloration and an unsanitary condition, particularly if not refrigerated. An oxygen barrier is also formed by the film 22, thereby increasing the shelf-life of the ingredients 11. The backup seams insure that the contents 11 cannot escape if one of the film-to-film seals, which are not as strong as the glued paper-to-paper seals, should fail, especially in the presence of the internal steam pressure generated during popping.

Figure 2:
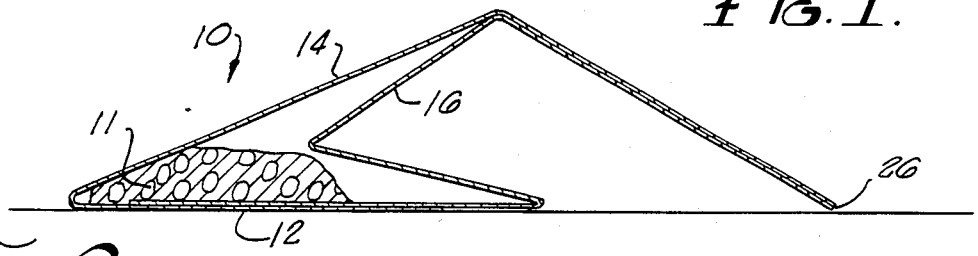
FIG. 2 is a cross-sectional view of the bag and contents taken along line 2—2 of FIG. 1.
Figure 3:
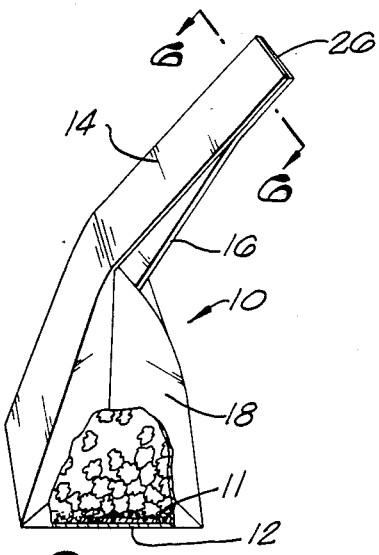
FIGS. 3 and 4 are partially broken away perspective side views of the bag and contents as the popping process begins and as it nears completion, respectively.
Figure 4:
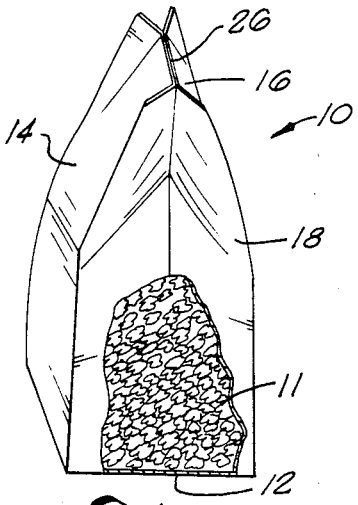
Figure 5:
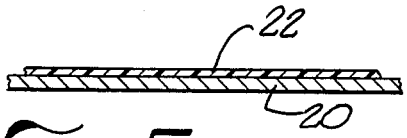
FIG. 5 is a cross-sectional view showing the material of which the bag is made.

When the bag 10 is ready for use by the consumer, it is placed in a microwave oven 32 (as shown in FIG. 1) with the bottom panel 12 of the bag resting on the oven floor 34, as shown in FIG. 2. As the microwave energy is absorbed by the corn kernels, their moisture content turns to steam, causing popping, and the steam begins to fill the bag 10 causing it to assume an expanded upright condition, first as shown in FIG. 3 and then as shown in FIG. 4. Lower portions of the gussetted sides 18 open but the top edge 26 of the bag 10 remains sealed against this pressure, at least during the earlier stages of the popping process. The steam cannot escape from the bag 10 because of the Mylar film 22. If the steam were allowed to escape prematurely, the product volume would be too low and the popped corn would be too dry and overcooked. It should be noted that the expansion of the bag 10 due to the internal steam pressure creates a vertical space of considerable height above the bottom panel 12 to permit free and unrestricted popping action, thus reducing the number of unpopped kernels.

As mentioned above, the peelable seal along the top edge 26 of the bag 10 is the most easily separated film-to-film seam, this being the result of the manner in which the heat seal coating is applied and processed. In addition, there is no backup paper-to-paper seam along the top edge 26. Accordingly, as the pressure builds up the seam along the top edge 26 will be the first to open. The strength of the top edge seal is such that, with corn kernels having a moisture content of 11.5 percent or more by weight, that seam will remain sealed for at least the first one-half of the popping time.

Figure 7:
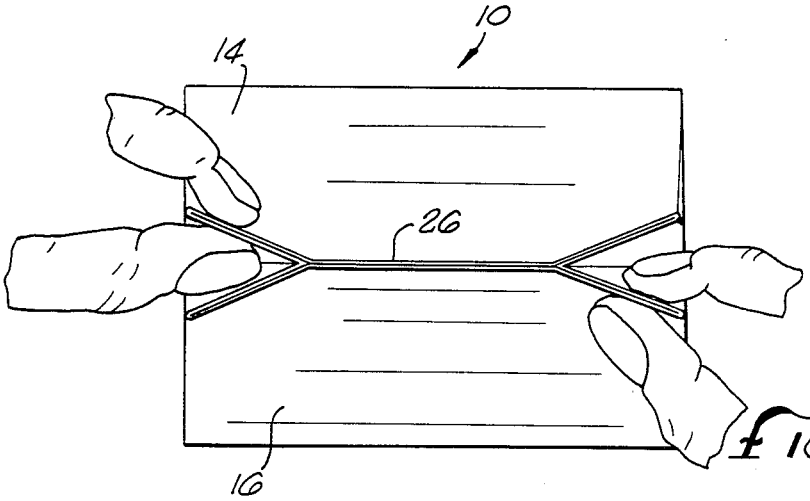
FIGS. 7 and 8 are top views of the bag being opened.
Figure 8:
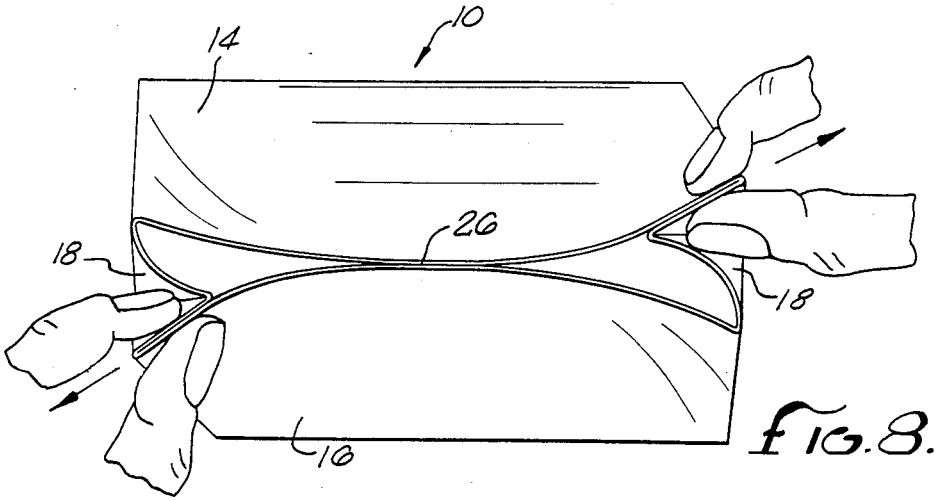

When the bag 10 is removed from the oven 32, the top edge seal provides a quick and convenient arrangement for opening the bag 10. As shown in FIG. 7, diagonally opposite corners of the bag 10 are grasped and pulled apart. To more fully open the bag 10, the two remaining diagonally opposite corners can then be pulled in the same manner, as shown in FIG. 8. This arrangement is highly sanitary since the person opening the bag 10 need not at any time touch the inside surface or the ingredients 11. Opening can be accomplished when the bag 10 is hot, which is particularly advantageous if the steam is still contained within the bag.

Although the seal along the top edge 26 may be made so as to remain closed throughout the entire popping process, it is advantageous that it open during the last one-half of the process, preferably before the last thirty seconds, to allow steam to escape. It is then possible to allow the bag 10 to stand without attention after the popping process has been completed, as is likely to happen in the event that the microwave oven 32 is equipped with a timer. If the bag 10 were allowed to stand for only a few minutes with the steam trapped inside, the popcorn would become undesirably chewy.

It should be noted that the bag 10 has a center strip 36 where the front panel 14 and the back panel 16 come into contact with each other when the bag is folded flat, as shown in FIG. 6. Whereas there are only two thicknesses of the inner and outer layers in the center strip 30, there are more thicknesses in the area of the gussets 18. On one side where the seam 28 extends vertically up the bag 10 across one of the gussets there are six thicknesses. Since the seal along the top edge 26 is formed by the application of pressure and heat, it will, in the absence of special provisions to eliminate this effect, be less secure along the center strip 36 where the pressure is least. Therefore the center portion of the top edge 26 is the primary venting portion of the seal, although in exceptional cases other portions of the top edge seal may vent first. The most frequent location for venting to take place is indicated in FIG. 6 by the letter "V" and is adjacent to the side of the bag 10 where there are six thicknesses, this being the area in which there is the greatest reduction in the width of the top edge thickness.

As will be appreciated from the above description, the present invention provides a convenient and easy to use popcorn ingredient and container combination suitable for use in microwave ovens. The unique construction of the bag, with its coated inner layer, provides a convenient and sanitary easy-opening feature and provides for self-venting of the steam.

While a particular form of the invention has been illustrated and described, it will be apparent that various modifications can be made without departing from the spirit and the scope of the invention. Accordingly, it is not intended that the invention be limited, except as by the appended claims.

We claim:

1. For use in a microwave oven, a shelf-stable combination of an easily opened bag and a mixture of edible popcorn ingredients for popping therein:

said bag comprising a front panel, a back panel and inwardly folded gussetted side panels, said panels being arranged such that said bag can be flattened with said gussets closed and said front and back panels contacting each other along a center strip between said gussets, said bag then forming a top edge having the least thickness along said center strip;

said panels comprising a paper outer layer and an inner layer that is non-wicking with respect to grease and transparent to microwave energy, portions of said panels constituting seal means comprising a coating that is a part of said inner layer and is sensitive to pressure and heat, said seal means being formed by pressure and heat along said top edge such that opposing surfaces of said inner layer are adhered to each other relatively more securely along first seal areas corresponding to said gussets and relatively less securely along a second seal area corresponding to said center strip, said seal means being effective for (1) closing said entire top edge prior to heating of said ingredients to cause popping and maintaining said top edge in a closed condition for a part of said heating to cause steam to be retained during heating and popping of said ingredients until a predetermined internal pressure is reached, (2) opening automatically along at least a portion of said second seal area in response to said predetermined internal pressure during popping to allow steam to escape, and (3) opening further along at least a portion of said first seal area in response to being pulled at diagonally opposite corners formed by said gussets; and said structure being disposed within said bag and comprising shortening and corn kernels having a moisture content of at least about 11.5 percent by weight, whereby sufficient internal pressure is generated at a temperature of not more than 350° to 450° F. to open said seal along at least a portion of said top edge.

2. The combination of claim 1 wherein said coating is a polyester.

3. The combination of claim 1 wherein said inner layer is polyethylene terephthalate.

4. The combination of claim 1 wherein said shortening is a solid at room temperature.

5. The combination of claim 1 wherein said coating covers the entire inner surface of said bag exposed to said ingredients.

6. The combination of claim 1 wherein said moisture content of the corn is about 13 to 14 percent by weight.

7. The combination of claim 1 wherein:

said inner layer is polyethylene terephthalate;

said coating is a polyester and covers the entire inner surface of said bag exposed to said ingredients;

said moisture content of the corn is about 13 to 14 percent by weight; and said shortening is a solid at room temperature.

8. The combination of claim 1 wherein said inner layer is a polymer.

9. The combination of claim 1 wherein said inner layer is a crystalline polymer having an amorphous coating thereon.

10. The combination of claim 1 wherein said bag has a standup configuration and further comprises a bottom panel, said ingredients being positioned adjacent to said bottom panel.

11. For use in a microwave oven, a shelf-stable combination of an easily-opened bag and a mixture of edible popcorn ingredients for popping therein:

said bag comprising a bottom panel, a front panel, a back panel and inwardly folded gusseted side panels, said panels being arranged such that said bag can be flattened with said gussets closed and said front and back panels contacting each other along a center strip between said gussets, said bag then forming a top edge opposite said bottom panel having the smallest thickness along said center strip, said bag having a kraft paper outer layer and an inner layer comprising polyethylene terephthalate and covering the entire surface exposed to the interior of said bag, portions of said panels constituting seal means comprising a coating that is a part of said inner layer and is sensitive to pressure and heat, said seal means being formed by pressure and heat along said top edge such that opposing surfaces of said inner layer are caused to adhere to each other relatively more securely along first seal areas corresponding to said gussets and relatively less securely along a second seal area corresponding to said center strip, said seal means being effective for (1) closing said entire top edge prior to heating of said ingredients to cause popping and maintaining said top edge in a closed condition for a part of said heating to cause steam to be retained during popping of said ingredients until a predetermined internal pressure corresponding to an ingredient temperature of about 350° to 450° F. is reached, (2) opening automatically along at least a portion of said second seal area in response to said predetermined internal pressure during popping to allow steam to escape, and (3) opening further along substantially said entire top edge in response to being pulled at diagonally opposite corners formed by said gussets; and said popcorn ingredients being positioned adjacent said bottom panel and comprising corn kernels and a shortening that is a solid at room temperature, said kernels having a moisture content of about 13 to 14 percent by weight whereby said predetermined pressure is reached prior to the last 30 seconds of said popping process.

12. The combination of claim 11 wherein:

said inner layer is polyethylene terephthalate;

said coating is a polyester and covers the entire inner surface of said bag exposed to said ingredients;

said moisture content of the corn is about 13 to 14 percent by weight; and said shortening is a solid at room temperature.

13. For use in a microwave oven, a shelf-stable combination of an easily opened bag and a mixture of edible popcorn ingredients for popping therein:

said bag comprising a front panel, a back panel and inwardly folded gussetted side panels, said panels being arranged such that said bag can be flattened with said gussets closed and said front and back panels contacting each other along a center strip between said gussets, said bag then forming a top edge having the least thickness along said center strip;

said panels comprising a structural outer layer, and an inner layer that is non-wicking with respect to grease and transparent to microwave energy, portions of said panels constituting seal means formed by pressure and heat along said top edge such that opposing surfaces of said inner layer are adhered to each other relatively more securely along first seal areas corresponding to said gussets and relatively less securely along a second seal area corresponding to said center strip, said seal means being effective for (1) closing said entire top edge prior to heating of said ingredients to cause popping and maintaining said top edge in a closed condition for a part of said heating to cause steam to be retained during heating and popping of said ingredients until a predetermined internal pressure is reached, (2) opening automatically along at least a portion of said second seal area in response to said predetermined internal pressure during popping to allow steam to escape, and (3) opening further along at least a portion of said first seal area in response to being pulled at diagonally opposite corners formed by said gussets; and said ingredients being disposed within said bag and comprising shortening and corn kernels having a moisture content of at least about 11.5 percent by weight, whereby sufficient internal pressure is generated at a temperature of not more than 350° to 450° F. to open said seal along at least a portion of said top edge.

* * * * *

UNITED STATES PATENT AND TRADEMARK OFFICE

CERTIFICATE OF CORRECTION

PATENT NO. : 4,571,337

DATED : February 18, 1986

INVENTOR(S) : James K. Cage et al.

It is certified that error appears in the above-identified patent and that said Letters Patent is hereby corrected as shown below:

IN THE CLAIMS:

Col. 5, line 42, delete "structure" and insert therefor -- ingredients --.

Col. 6, line 53, delete existing claim 12 and insert therefor:

-- 12. The combination of claim 11 wherein:

said inner layer is polyethylene terephthalate;

said coating is a polyester and covers the entire inner surface of said bag exposed to said ingredients; and said shortening is a solid at room temperature. --

Signed and Sealed this

Eighteenth Day of November, 1986

*Attest:*

DONALD J. QUIGG

*Attesting Officer* *Commissioner of Patents and Trademarks*